United States Patent [19]

Jadot

[11] 4,020,884

[45] May 3, 1977

[54] PLASTIC BAGS

[76] Inventor: Pierre Gaston Benoit Jadot, 56, Bd. E. Machtens, Molenbeek-Saint-Jean, Belgium

[22] Filed: Dec. 2, 1975

[21] Appl. No.: 636,955

[30] Foreign Application Priority Data

Dec. 6, 1974 Belgium ..... 151241

[52] U.S. Cl. ..... 150/3; 24/201 C

[51] Int. Cl.[2] ..... B65D 33/24

[58] Field of Search ..... 150/3; 24/201 C

[56] References Cited

UNITED STATES PATENTS

| | | | |
|---|---|---|---|
| 2,144,755 | 1/1939 | Freedman | 150/3 UX |
| 2,772,712 | 12/1956 | Post | 150/3 |
| 3,324,520 | 6/1967 | Ausnit | 150/3 X |
| 3,389,733 | 6/1968 | Siegel | 150/3 |
| 3,410,327 | 11/1968 | Ausnit | 150/3 |
| 3,746,215 | 7/1973 | Ausnit | 150/3 UX |
| 3,790,992 | 2/1974 | Herz | 150/3 |
| 3,808,649 | 5/1974 | Ausnit | 150/3 X |

*Primary Examiner*—Donald F. Norton
*Attorney, Agent, or Firm*—Cushman, Darby & Cushman

[57] ABSTRACT

A plastic bag has interengageable male and female closure elements on the inner walls adjacent to the bag opening. A yieldable diaphragm extends across the opening of the female element to prevent engagement of the elements during manufacture, handling and stacking.

4 Claims, 4 Drawing Figures

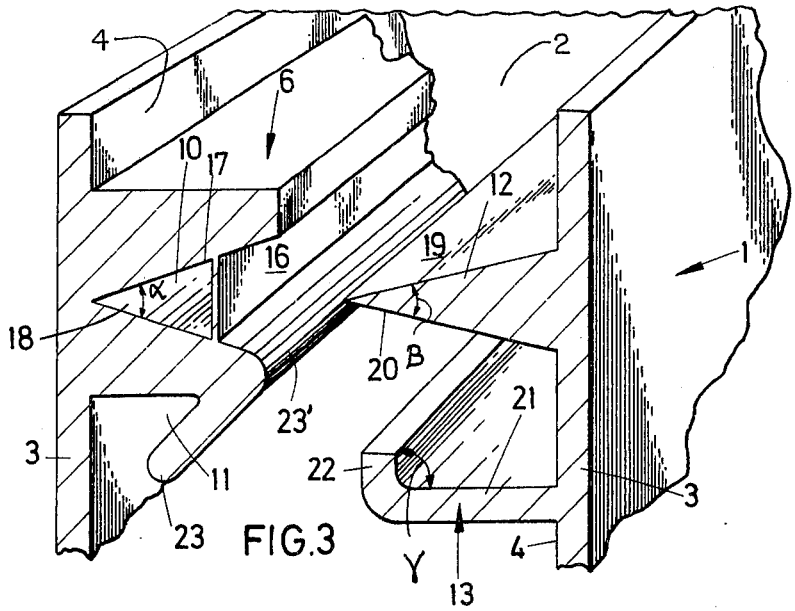
FIG.3
FIG.4
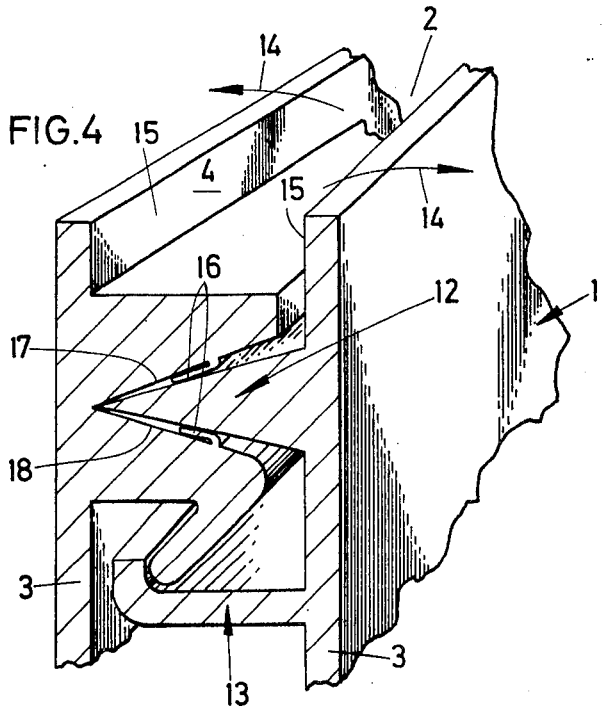

PLASTIC BAGS

This invention relates to a plastic bag which is provided adjacent the opening thereof and on the inner surfaces of the opposite bag walls, with at least one set of male and female elements which are to be engaged inside one another to close the bag.

Bags with such a design have the drawback that during the handling and storage into stacks of the empty bags, pressures exerted on said male and female elements engage same inside one another and thus cause the bags to be closed, which makes it necessary for the user when it is desired to fill the bags, to first open said bags by hand. Said drawback has become more important as presently the bagging of many products is more and more mechanized and the bagging machines do not have suitable means for opening an empty bag provided with the above-described closing means when said elements are engaged inside one another, the opening of the empty bags being indeed performed by blowing pressurized air into the bag.

The invention has for object to obviate said drawback and to provide a bag the closing means of which cannot operate under the usual pressures resulting from the bag handling and storage. The invention has moreover for object to provide a particularly reliable device for closing bags.

For this purpose according to the invention, means are provided on said element set to prevent the engagement together of said male and female elements, said means being so arranged as to withstand a pressure which is at least equal to that pressure which is exerted on the element set during the manufacture, the handling and the stacking of the empty bag.

In one embodiment of the invention, said means are provided on the female element.

In an advantageous embodiment of the invention, said means are comprised of a diaphragm which extends across the opening provided in the female element and through which said male element passes to enable the closing of the bag.

In a particularly advantageous embodiment of the invention, said female element comprises two superimposed grooves in parallel relationship while the male element has two ribs each one of which will co-operate with the corresponding groove in the female element, those corresponding groove and rib nearest the bag opening being so arranged that when the rib is engaged inside the groove, they will prevent in the location where the bag is closed, the sliding of the bag walls relative to one another, while those corresponding groove and rib farthest away from the bag opening are so arranged that when the rib is engaged inside the groove, they will prevent in the location where the bag is closed, the spreading away of the bag walls, those rib and groove nearest the bag opening being moreover so arranged as to lock the other rib inside the associated groove when a pressure is exerted from inside the bag on the bag walls, said means for preventing the engagement of the male and female elements inside one another being arranged in that groove nearest the bag opening.

Other details and features of the invention will stand out from the description given below by way of non limitative example and with reference to the accompanying drawings, in which.

Figure 1:
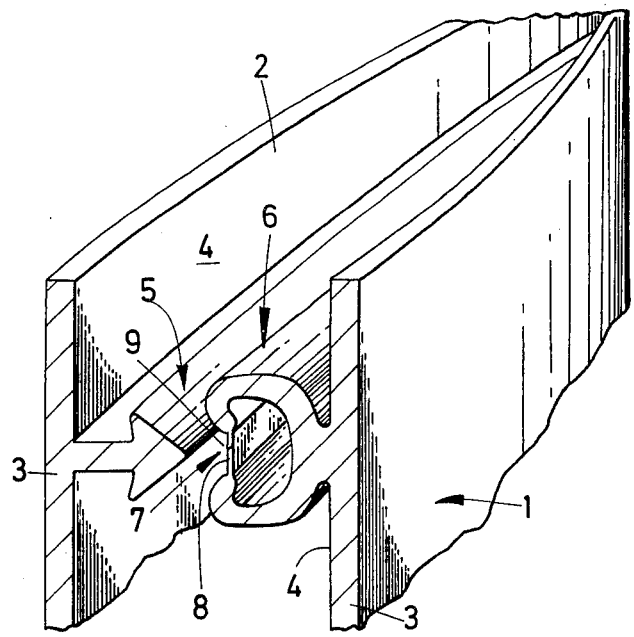
FIG. 1 is a part view in cross-section and in perspective, of an open bag provided with a closing device according to the invention.
Figure 2:
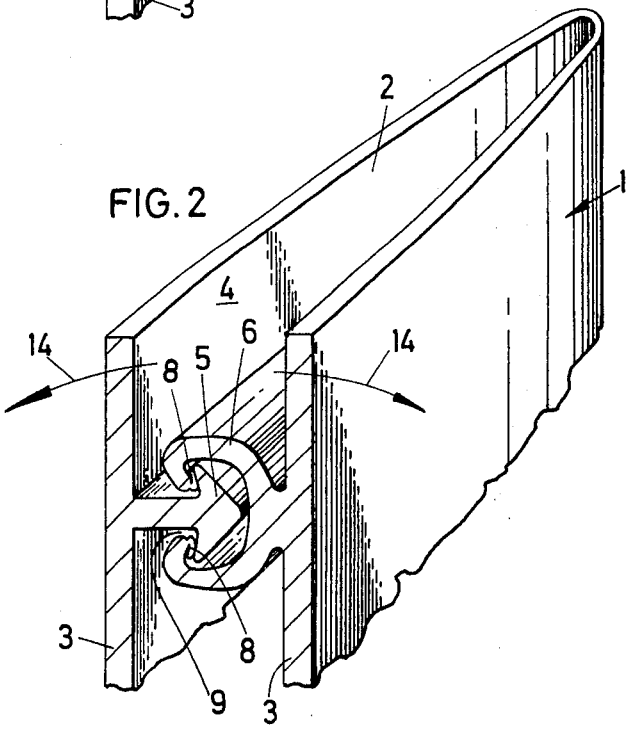
FIG. 2 is view similar to FIG. 1, with the bag closed.

FIGS. 3 and 4 are views similar to FIGS. 1 and 2 which show a bag provided with a closing device which comprises a variation of the closing device fitted to the bag as shown in FIGS. 1 and 2.

In the various figures, the same reference numerals pertain to similar elements.

The bag 1 as shown in FIGS. 1 and 2 is provided adjacent the opening 2 thereof and on the inner surfaces 4 of the opposite bag walls 3, with the usual male element 5 and female element 6 which are to be engaged inside one another under pressure to insure the closing of said bag. According to the invention and to prevent the male element 5 being engaged inside the female element 6 to close the empty bag during the handling and storage thereof, on said bag closing device are provided means 7 which are so arranged as to withstand a pressure which is at least equal to that pressure which is exerted on elements 5 and 6 during the manufacture, the handling and the stacking of the empty bags. Said means 7 are advantageously provided on the female element 6 and are comprised of a diaphragm 8 which extends across the opening 9 provided in said female element and through which passes said male element to close the bag.

The bag according to the invention as shown in FIGS. 3 and 4 is provided with a particularly reliable closing device which is so designated as to withstand positively those pressures exerted from inside the bag on the closing device while still allowing to open easily said device. The element 6 in said closing device comprises two superimposed grooves 10 and 11 in parallel relationship, while the male element 5 is provided with two ribs 12 and 13 for co-operating respectively with said grooves 10 and 11. The groove 10 and the rib 12 are so arranged as to prevent when the rib is engaged inside the corresponding groove in the location where the bag is closed, the sliding of the bag walls 3 relative to one another, while the groove 11 and the rib 13 are so arranged as to avoid in the location where the bag is closed, the spreading away of said bag walls. The groove 10 and the rib 12 are moreover so arranged as to lock the rib 13 in the groove 11 thereof when a pressure is exerted from inside the bag on the walls 3 and to allow an easy release of said rib 13 from groove 11 when pulling along the direction of arrows 14 the portion 15 of bag walls 3. Said means 7 for preventing the engagement of male and female elements 5, 6 together are advantageously provided in groove 10 and comprised of a diaphragm 16 which extends across the groove over the complete length thereof. The rib 12 has advantageously a cross-section in the shape of an isosceles triangle the base of which coincides with the surface 4 of corresponding bag wall 3 while the groove 10 with a cross-section in the shape of an isoceles triangle and the opening of which lies substantially in parallel relationship with bag wall 3, forms with both sides 17 and 18 thereof an angle $\alpha$ which is slightly larger than the angle $\beta$ formed by both sides 19 and 20 of rib 12, the side 17 of groove 10 having a dimension as considered cross-wise to the groove which is larger than the dimension of groove side 18. The rib 13 has a cross-section of L-shape the leg 21 of which extends substantially at right angle to bag wall 3 while the other leg 22 extends towards the bag opening 2, the groove 11 corresponding to rib 13 having an opening substantially at right angle to bag wall 3 facing inwards, being so arranged that with the bag closed, the free edge 23 of the female element comes to lie within that angle $\gamma$ formed by both legs 21 and 22 of rib 13. The size of said rib 13 is slightly smaller than the size of rib 12 as considered at right angle to bag wall 3.

When a pressure is exerted on the bag walls inside the bag, rib 13 tries to leave groove 11 but it is locked therein because the surface 19 of rib 12 bears under the action of said pressure, on the surface 17 of groove 10. However, the difference in size between the surfaces 17 and 18 of groove 10 and between ribs 12 and 13 allows to release easily the male element from the female element when pulling along the direction of arrows 14 the portion 15 of the bag walls, without the rib 12 performing the locking action thereof, said release being moreover made easier by the rounded shape provided in 23′ on the female element 5. The bag walls 3, the male and female elements 5, 6 and said means 7 are advantageously manufactured as an unit by extruding.

It must be understood that the invention is in no way limited to the above embodiments and that many changes can be brought therein without departing from the scope of the invention as defined by the appended claims.

I claim:

1. A plastic bag, provided adjacent the opening thereof, and on the inner surfaces of the opposite bag walls, with at least one male element which is engageable within an opening within at least one female element to close the bag, there being a yieldable diaphragm which extends across the opening in the female element and through which the male element must pass to enable closing of the bag whereby said male and female elements do not engage during manufacture, handling and stacking.

2. A plastic bag, provided adjacent the opening thereof, and on the inner surfaces of the opposite bag walls, with at least one set of male and female elements the male element of which is to be engaged inside the female element to close the bag, and means on said element set to prevent the engagement together of said male and female elements whereby said male and female elements do not engage during manufacture, handling and stacking, the female element comprising two superimposed grooves in parallel relationship and the male element having two ribs each one of which will co-operate with the corresponding groove in the female element, the corresponding groove and rib nearest the bag opening being so arranged that when the rib nearest the bag opening is engaged inside the groove sliding of the bag walls relative to one another in the location where the bag is closed is prevented while the corresponding groove and rib farthest away from the bag opening are so arranged that when the rib farthest from the bag opening is engaged inside the groove spreading away of the bag walls in the location where the bag is closed is prevented, the rib and groove nearest the bag opening being so arranged as to lock the other rib inside the associated groove when a pressure is exerted from inside the bag on the bag walls, said means for preventing the engagement of the male and female elements inside one another being arranged in that groove nearest the bag opening.

3. A plastic bag as claimed in claim 2, in which that rib nearest the bag opening has a cross-section in the shape of a triangle the base of which coincides with the bag wall while the corresponding groove with a triangular cross-section and the opening thereof lying substantially in parallel relationship with the bag wall has both sides thereof forming an angle which is slightly larger than the angle formed by both rib sides, that groove side nearest the bag opening having a dimension crosswise to said groove which is larger than the dimension of the other groove side, that rib farthest away from the bag opening having an L-shaped cross-section the one leg of which extends substantially at a right angle to the bag wall while the other leg thereof extends toward the bag opening, the groove which cooperates with the L-shaped leg having an opening lying substantially at a right angle to the bag wall and facing inwards, being so arranged that when the bag is closed, the female element having a free edge which comes to lie within the angle formed by both rib legs, the size of said rib farthest from the bag opening being slightly smaller than the size of that rib nearest the bag opening as considered at right angle to the bag wall.

4. A plastic bag as claimed in claim 3, in which the cross-section of that rib nearest the bag opening is in the shape of an isosceles triangle.

* * * * *